US006607221B1

(12) United States Patent
Elliott

(10) Patent No.: US 6,607,221 B1
(45) Date of Patent: Aug. 19, 2003

(54) WINDOW LATCH SYSTEM

(76) Inventor: Gordon W. Elliott, 103 Cedarwood Ct., Forest, VA (US) 24551-2203

( * ) Notice: Subject to any disclaimer, the term of this patent is extended or adjusted under 35 U.S.C. 154(b) by 0 days.

(21) Appl. No.: 10/208,758

(22) Filed: Aug. 1, 2002

(51) Int. Cl.[7] ..... G05C 9/10

(52) U.S. Cl. ..... 292/33; 292/DIG. 20; 292/DIG. 47; 292/7; 292/40; 292/DIG. 53; 49/445; 49/446; 49/449; 49/450

(58) Field of Search ..... 292/DIG. 20, DIG. 47, 292/7, 6, 5, 33, 36, 41, 40, DIG. 53, DIG. 60, DIG. 61, DIG. 70; 49/449, 450, 445, 446, 447

(56) References Cited

U.S. PATENT DOCUMENTS

| | | | | | |
|---|---|---|---|---|---|
| 345,483 | A | * | 7/1886 | Cole | 292/305 |
| 346,516 | A | * | 8/1886 | Tankersly | 292/209 |
| 784,446 | A | * | 3/1905 | Taylor et al. | 292/37 |
| 1,747,707 | A | * | 2/1930 | Grosse | 292/204 |
| 4,227,725 | A | * | 10/1980 | Lindquist et al. | 292/202 |
| 4,303,264 | A | * | 12/1981 | Uehara | 292/7 |
| 4,893,849 | A | * | 1/1990 | Schlack | 292/7 |
| 5,076,015 | A | | 12/1991 | Manzalini | |
| 5,090,750 | A | | 2/1992 | Lindqvist | |
| 5,104,161 | A | * | 4/1992 | Kautt | 292/157 |
| 5,127,685 | A | | 7/1992 | Dallaire et al. | |
| 5,244,238 | A | * | 9/1993 | Lindqvist | 292/7 |
| 5,370,428 | A | * | 12/1994 | Dreifert et al. | 292/161 |
| 5,398,447 | A | | 3/1995 | Morse | |
| 5,452,543 | A | * | 9/1995 | VonWald et al. | 49/346 |
| 5,715,631 | A | | 2/1998 | Kailian et al. | |
| 5,791,700 | A | * | 8/1998 | Biro | 292/7 |
| 5,901,499 | A | | 5/1999 | Delaske et al. | |
| 5,992,907 | A | * | 11/1999 | Sheldon et al. | 292/34 |
| 6,139,071 | A | * | 10/2000 | Hopper | 292/158 |
| 6,141,913 | A | | 11/2000 | Wong et al. | |
| 6,178,696 | B1 | | 1/2001 | Liang | |
| 6,286,262 | B1 | * | 9/2001 | Prevot et al. | 49/371 |

* cited by examiner

*Primary Examiner*—Robert J. Sandy
*Assistant Examiner*—Dinesh N Melwani
(74) *Attorney, Agent, or Firm*—Stevens, Davis, Miller & Mosher, LLP

(57) ABSTRACT

A sliding latch and locking mechanism, for windows and doors, whereby the latching mechanism provides a means for discrete position retention of a sliding window or door and provides an increased measure of security. The latching system combines four modes of operation i.e. lock, close only, raise (free sliding), and tilt to provide angular pivoting of window sash, that allow three levels of security, i.e. fully locked, close only with discrete positions maintained, and raise or lower without discrete positions maintained (free sliding). The latching system security levels are accomplished by means of a selector knob positioned to the desired mode of operation. Also, a mechanism is integrated to provide interlocking in the fully closed position with the upper or adjacent window or door sash.

31 Claims, 11 Drawing Sheets

WINDOW LATCH SYSTEM

I. FIELD OF THE INVENTION

The present invention relates to a sliding latch for windows and doors.

II. BACKGROUND OF THE INVENTION

Locking mechanisms for sash windows are known in which, in the closed position, the handle of the locking mechanism engages an opposing receiving element affixed to the adjacent rail of the other window sash. Such latch mechanisms are effective for maintaining a window in a closed position, but are ineffective for holding the window in an intermediate partially open locked position.

This invention arises from a long standing need to allow a window to remain in a position from fully closed to fully open while not allowing the opening to be increased in size from an exterior vantage point. However, the opening can decrease in size, while in a retained unlocked position, thereby providing increased security of an interior home or building by an unsuspecting intruder.

The most common need is for sliding casement windows and doors, however the invention can be applied to other window and door applications.

The following prior United States patents are incorporated herein by reference:

U.S. Pat. Nos. 5,090,750; 6,141,913; 6,178,696; 5,398,447; 5,715,631; 5,127,685; 5,076,015; 5,090,750; and 5,901,499.

The referenced patents have components such as latch mechanisms, cams, and connecting rod members. However, the application and arrangement of the components differs significantly in the modal operation of the invention presented in this disclosure. Also, these patents do not allow for intermediate locked positions of the window or door sash.

III. SUMMARY OF THE INVENTION

The invention provides locking of a sliding window or doorframe member in discrete positions from an interior vantage point. The mechanism for locking the window is at the top most frame member, away from the opening, creating interference for defeating the locking mechanism through a partial opening.

The invention also provides the ability to accommodate tilt-in or pivoting features for cleaning or removal of the window or door. The latch and locking system can be applied to both new and existing window and door systems.

The present invention includes a combination of simple mechanisms for providing locking and retention of windows or doors within their sliding frame members. The invention allows for integration of a complete latching system into new window or door systems and adaptation to existing installations. Existing installations may be limited in some cases to only allow certain features of the invention to be applied. Diametrically opposing latches are utilized to provide latching points on each side of the window or door. The latches are operated from a common center point hub, enabling the latching and lifting or sliding to be accomplished from this vantage point. The invention allows for the latching system to operate in different modes by means of a selector knob constituting a major advantage to the present invention. Without the innovation of retained selection modes, it would not be possible to lock a window or door in an intermediate position. In addition, the capability of intermediate locking positions supports the innovation of a higher level of building security while doors or windows remain partially open.

IV. DESCRIPTION OF DRAWINGS

The present specification references the following drawings wherein like numerals designate like elements.

V. DETAILED DESCRIPTION OF THE PREFERRED EMBODIMENTS

Figure 1:
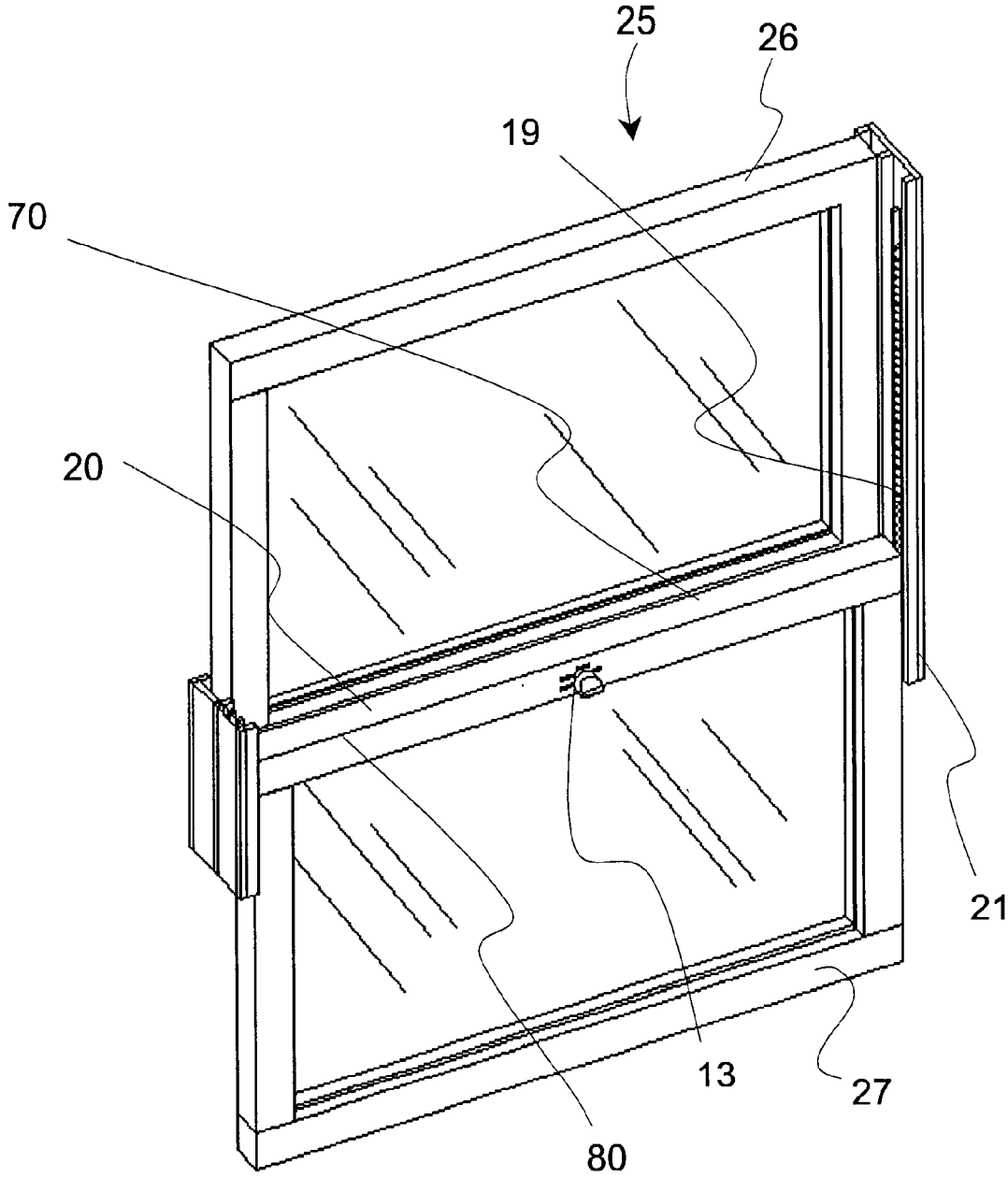
FIG. 1 is an isometric view of a first embodiment of a partial window frame and sash assembly provided with a latching system according to the present invention.
Figure 1A:
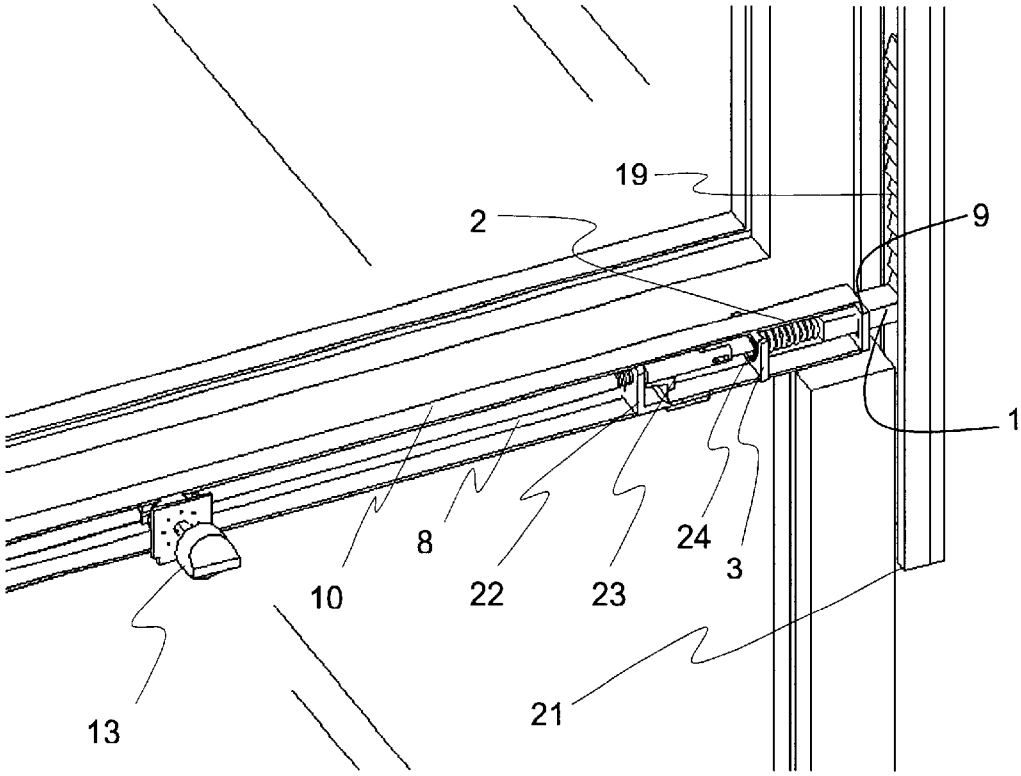
FIG. 1A is an isometric view of a portion of the window of FIG. 1 with an outer portion cut away.

In the Figures the following elements, unless otherwise indicated, have the following reference numerals or letters, and like reference numerals or letters indicate like elements.

Number List

1 Latch Pin
2 Latch Pin Spring
3 Spring Retainer Clip
3A Spring Retainer Clip Front Slot
3B Spring Retainer Clip Rear Slot
4 Latch Pin Extension Shaft
5 Adjustment Linkage
6 Linkage Pin
6A Linkage Pin Hole
7 Jam Nut
8 Connecting Rod
9 Latch Pin End Cap
10 Latch Pin Housing
11 Spring Clip
12 Retaining Pin
13 Selector Knob
14 Retaining Plate
14A Semi-Spherical Indentations
15 Connecting Rod Pivot End
16 Hub Pin Detent
17 Selector Hub
18 Compression Spring
19 Latch Track
20 Sash Transverse Rail
21 Window Frame
22 Top Catch
23 Bottom Catch
24 "E"-Clip
24A "E"-Clip Groove
25 Window
26 Upper Sash
27 Lower Sash
30 Opening
60 Sliding Window\Door
70 Top Wall
80 Front Wall
105 "U" Shaped Channel
114 Retaining Plate
114A Mating Male Surface
116 Hub Pin
116A Female Indentation
117 Selector Hub
117A Female Indentation

Letter List

A. Not Used
B. Adjustment linkage slot
C. Retaining pin keying surface
D. Selector hub keying surface
E. Selector hub retaining pin spring clip slot
F. Retaining pin spring clip neck area
G. Retaining pin retention groove
H. Retaining pin chamfered end surface
I. Not used
J. Latch Track ramp surface
K. Latch track ramp tip/peak
L. Latch Track Wall
M. Latch pin distal tip
N. latch pin angled surface
W. Slot B Width
X. Slot B Length
$\alpha$ (alpha) is an angle
$\beta$ (beta) is an angle.

FIG. 1 shows a window employing a first embodiment of the window latch system of the present invention. The window 25 has an upper sash 26 and a lower sash 27. The window also has a top transverse rail 20, having a top wall 70, and a front wall 80. Both front wall 80 and top wall 70 are each also known as an outer wall.

The window latch system of FIG. 1 operates using a selector knob 13 that allows the window sash to be slid and locked into discrete positions along a window or door sash latch track 19 of the window frame 21. The latch system can be applied to existing sliding doors or windows and be integrated into new window system designs. The system is composed of four components that form the complete mechanism, i.e., a rotatable selector hub assembly, connecting rods, latch pin assemblies, and latch track.

The latching system mechanism, according to the present invention, is integrated into the top transverse rail 20 of the lower sash. Alternatively, the latching system can be enclosed in a rectangular tubing or casing to allow attachment or integration into an existing window or door sash as best seen in FIG. 14. The latching system is operated by a selector knob 13 located near the center of the top transverse rail 20. The locking mechanism depicted in FIG. 1, operates symmetrically about the vertical centerline of the selector hub 17. For simplicity, only one half of the mechanism is shown in FIG. 2, FIG. 3, FIG. 4, FIG. 5, FIG. 6, FIG. 8, FIG. 9, FIG. 10, FIG. 11, and FIG. 13.

Figure 3:
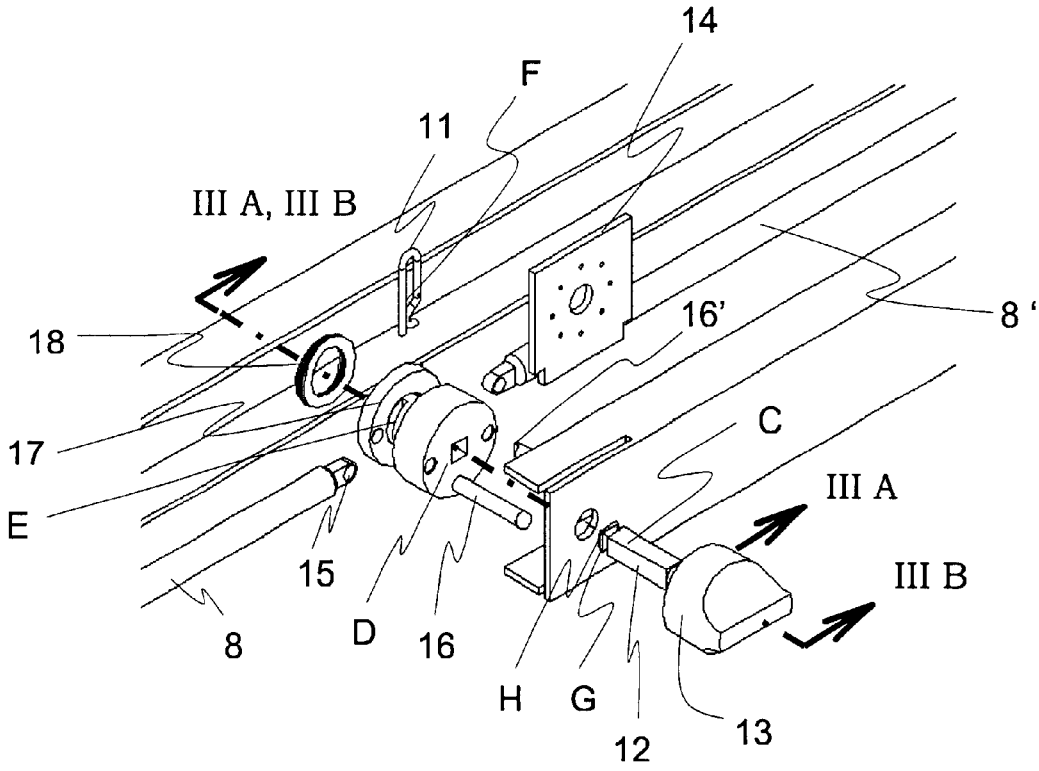
FIG. 3 is an isometric, exploded view of a rotatable selector hub, connecting rods, retention pin, and selector knob shown with partial window frame members of the embodiment of FIG. 1. The latch pin housing is shown in two sections for clarity.

The rotatable selector hub assembly is best shown in FIG. 3. A retaining pin 12 is engaged through an opening in the lower sash 20, to facilitate assembly of the knob 13 to the selector hub 17. The knob 13 is attached to the retaining pin 12 by common methods such as a screw or pin allowing the retaining pin 12 and knob 13 to rotate as one unit. The retaining pin 12 has a squared surface or keying surface C and mates with an interior surface D of selector hub 17 to allow the selector knob 13 to rotate the selector hub 17 to the desired position. The square surfaces of the selector hub 17 opening and the retaining pin 12 are described here as a representative method and shape, however, any shape which allows the selector hub 17 and the retaining pin 12 to be keyed, and subsequently allowing rotation of the hub when the knob 13 is rotated, could be employed without changing the spirit of the invention.

The modes of operation are differentiated by incorporation of a ratcheting detent mechanism. The components and method of the detent mechanism are described herein as representative. It is understood that the form of the detent mechanism is to be taken as a preferred example, and that various changes in shape sizes and arrangement of parts may be employed, while maintaining the spirit of the invention and subjoined claims. The significant features of this mechanism are that a tactile feedback and retention method of the selector hub for each operating mode are realized.

The selector hub 17 is a spool shaped component formed by a rear flange and a forward flange connected by a center cylinder with smaller diameter. The selector hub 17 contains the detent mechanism and accommodates a cylindrical pin 16, 16', located horizontally from each side of the center point. The cylindrical pin 16, 16', is used to connect the respective connecting rod end 15 to the selector hub 17. The cylindrical pin 16, 16', end surface is semi-spherical to allow the cylindrical pin to engage to opposing concave semi-spherical indentations 14A on retaining plate 14 (FIG. 3C).

The retaining pin 12 is attached to the selector hub 17 by means of a spring clip 11. The spring clip 11 is shown removed from the selector hub 17 for clarity. The spring clip 11 is inserted into selector hub retaining pin spring clip slot E (FIG. 3), which is actually two parallel slot portions, each slot portion respectively located horizontally from each side of the center axis IIIA—IIIA. The spring clip slot E protrudes toward the center of the selector hub center. The slot E intersects with the internal square hole D in the center of the selector hub 17. The spring clip 11 neck area F protrudes into the center of the selector hub 17 through each slot. The neck area of the spring clip 11 accepts a groove G located near the end of the retaining pin 12. A chamfered surface H on the retaining pin end allows the spring clip neck to engage and snap into place. This engagement allows for blind assembly of the retaining pin 12 and the selector hub 17.

A semi-spherical end of each cylindrical pin 16, 16', normal to the selector hub 17, is aligned with the opposing indentations 14A on the retaining plate 14.

Figure 3A:
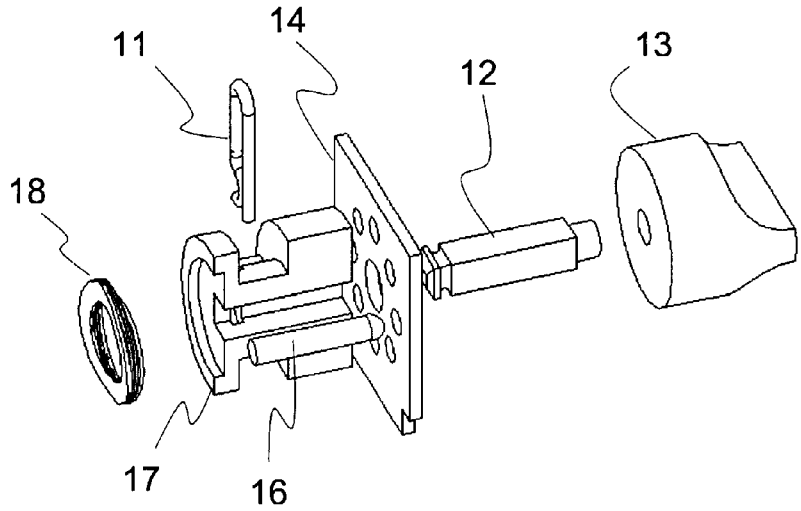
FIG. 3A shows a cross-section along view IIIA—IIIA of FIG. 3.
Figure 3B:
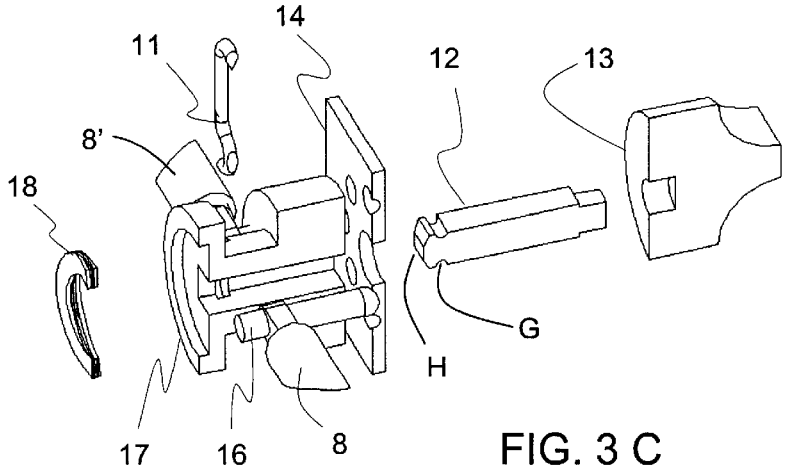
FIG. 3B shows a cross-section along view IIIB—IIIB of FIG. 3.
Figure 3C:
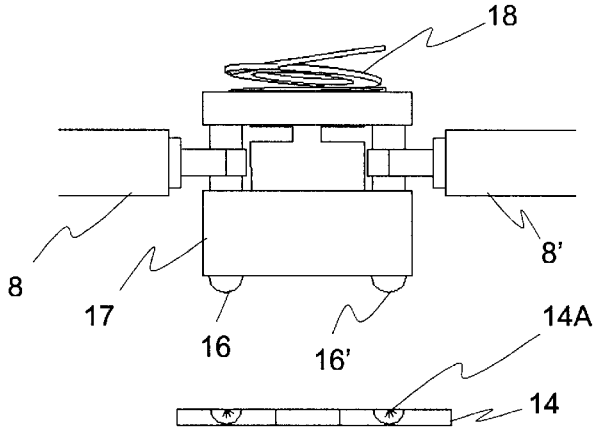
FIG. 3C shows a top view of a portion of FIG. 3.
Figure 3D:
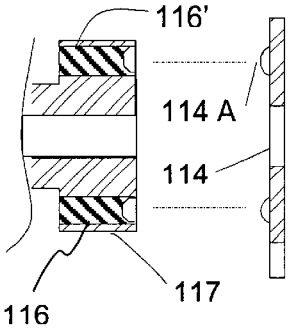
FIGS. 3D–3F show a modification to the embodiment of FIG. 3A wherein pins and a rotatable selector hub provide female indentations and a retaining plate provides mating male surfaces.
Figure 3E:
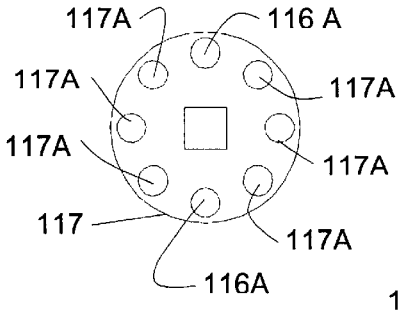
Figure 3F:
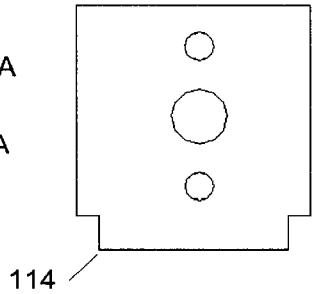
Figure 4:
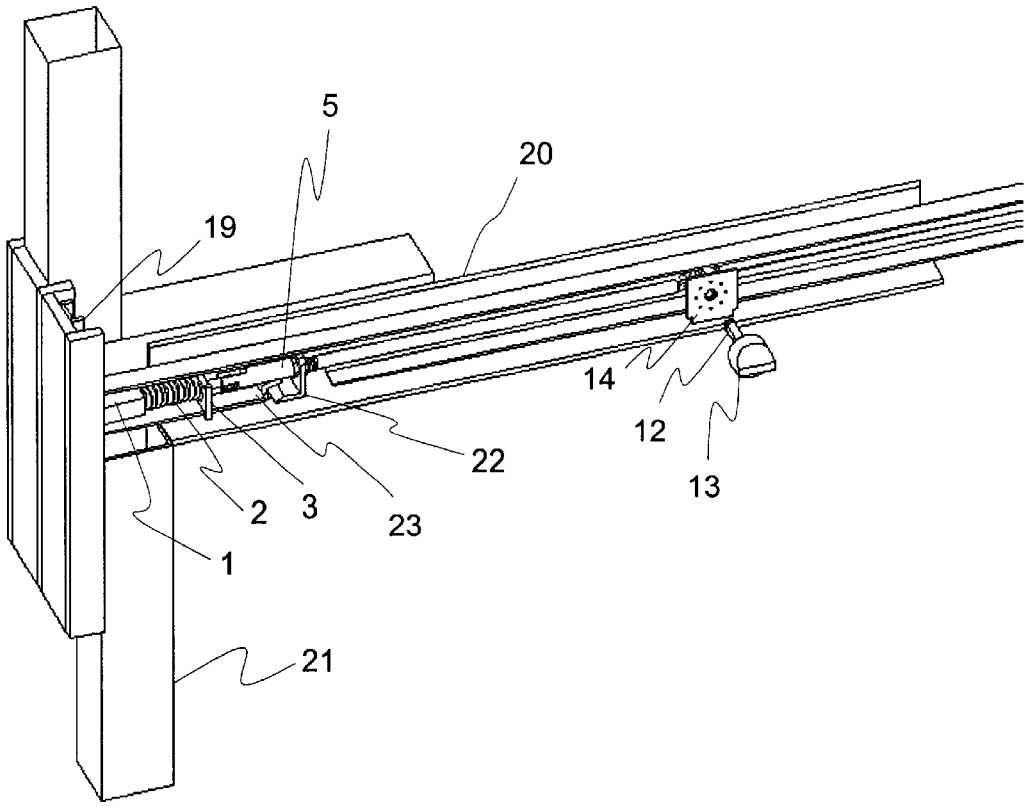
FIG. 4 is an isometric view of the complete latching system and latch track with the selector knob on the top sash rail face of the embodiment of FIG. 1.
Figure 5:
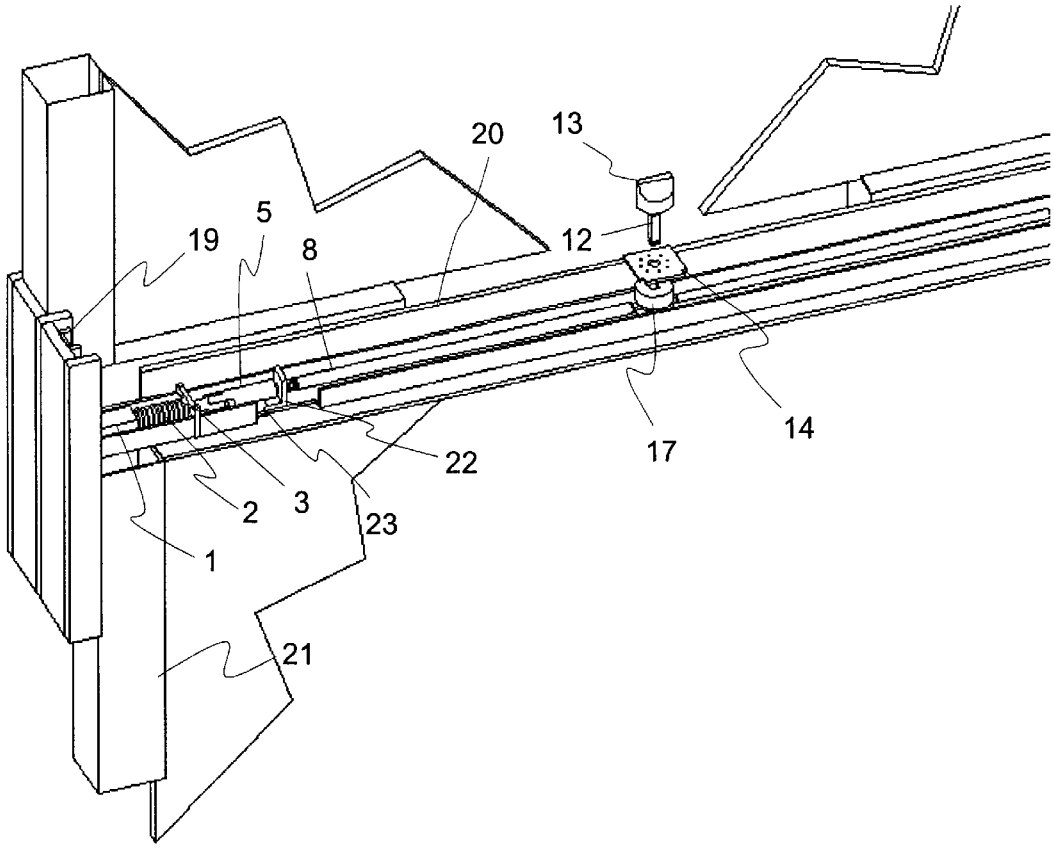
FIG. 5 is an isometric view of the complete latching system and latch track with the selector knob alternatively mounted on the sash top rail.

FIGS. 3D–3F show an alternative embodiment which is a modification to the embodiment of FIG. 3A wherein pins 116 provide concave semi-spherical female indentations 116A, and a rotatable selector hub 117 provides concave semi-spherical female indentations 117A, and a retaining plate 114 provides convex semi-spherical mating male surfaces 114A. Returning to the embodiment of FIG. 3A, the retaining pin 12 is attached to the selector hub by means of a spring clip 11.

The retaining plate 14 contains semi-spherical indentations 14A, located at angular increments, with respect to the center of the selector hub 17 face. The indentations 14A accept the semi-spherical end of the cylindrical pin 16 and thereby determine the amount of linear travel for each selectable mode depicted in FIG. 7. The cylindrical pin 16 ends are held into the respective indentations 14A on retaining plate 14 by means of a compression spring 18, located at the back side of the selector hub.

Figure 2:
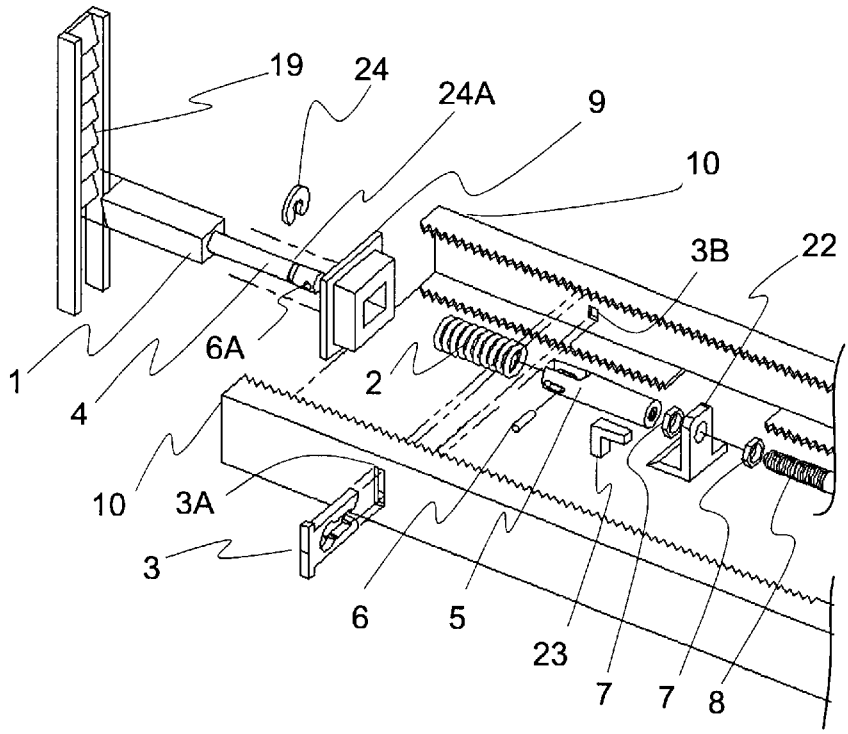
FIG. 2 is an exploded isometric view of the latch pin assembly with spring retention and adjustment linkage portion of the latching system of the embodiment of FIG. 1. The latch pin housing is shown in two sections for clarity.
Figure 2A:
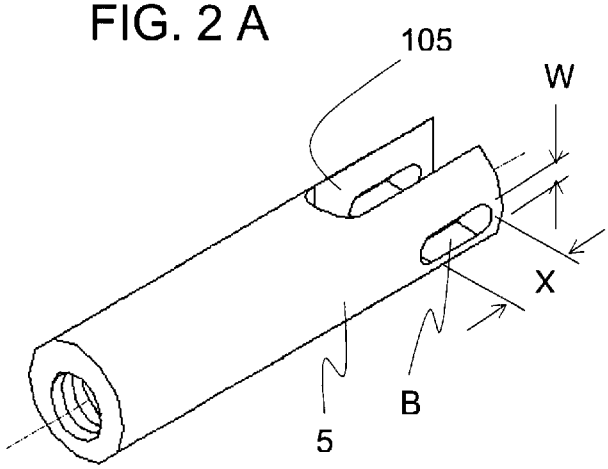
FIGS. 2A and 2B are isometric views of an adjustment linkage of the embodiment of FIG. 1.
Figure 2B:
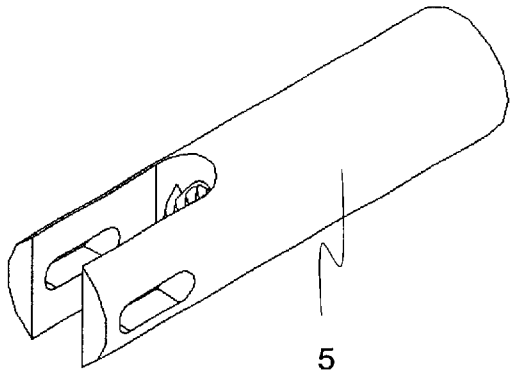

Attached to both sides of the selector hub 17 via connecting rod end 15, connecting rod 8, is used to drive a latch pin 1. The latch pin assembly can clearly be viewed in FIG. 2. The connecting rod 8 is attached to an adjustment linkage 5, using an internal thread on the adjustment linkage 5 and an external thread on the connecting rod 8. The hub pin 16, is used to maintain the proper position of the adjustment linkage 5 once the connecting rod 8, length is determined. The adjustment linkage 5 connects to the latch pin extension shaft 4 (FIG. 6) by means of a clevis joint (FIG. 2). The clevis joint has a "U" shaped opening 105 (FIG. 2A), and provides two (2) degrees of freedom for the latch pin, allowing rotation of the adjustment linkage about the latch pin extension shaft 4 transverse centerline and linear axial translation, of the connecting rod 8, with respect to latch pin 1, when the selector hub 17 is rotated. Adjustment linkage 5, rotation, is accomplished by means of an axially slotted, open end in the adjustment linkage 5. Axial translation of the latch pin extension shaft 4, is accomplished by means of an axial slot B along the horizontal axis centerline of the adjustment linkage 5, at an end portion opposite of the internally threaded end and located 90 radial degrees from the clevis slot 105. Slot B area extends through the adjustment linkage 5, diameter.

The adjustment linkage 5 is connected to the latch pin extension shaft 4 by a linkage pin 6, that extends through hole 6A in the latch pin extension shaft 4 and adjustment linkage 5, slot B. Axial slot B has length "X" and width "W". The width "W" is sufficient for pin 6 to pass through slot B. Length "X" is sufficient for pin 6 to reciprocally slide through slot B. This sliding linkage is of major importance to this invention as it allows the locking and the close only modes of operation for the latching mechanism. For clarity of explanation, references to this linkage mechanism are with respect to the left side of the latching system as shown in FIG. 1. The combination of pinned adjustment linkage 5 slot B, and latch pin extension shaft 4, is shown in FIG. 2 in the connecting rod 8 extended position, with cylindrical pin 6, diameter, in or near contact with adjustment linkage 5 slot B, right most radius (proximal-most radius relative to the rod 8) and is referred to subsequently as the locked position.

Figure 6:
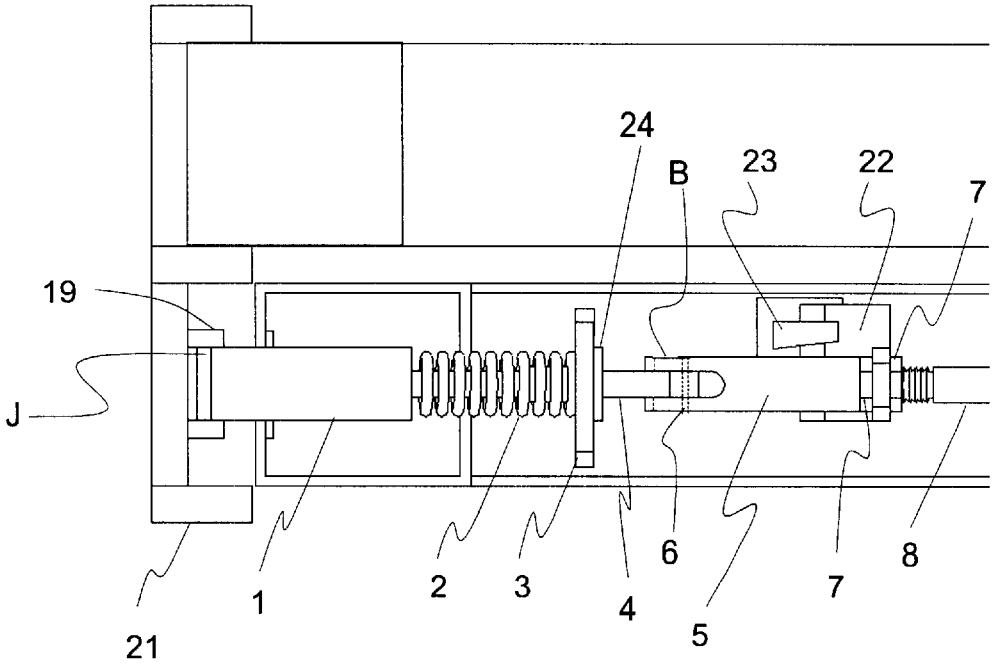
FIG. 6 is a top view of the latching mechanism shown inside a representative sash and frame of the embodiment of FIG. 1, wherein the latch pin is shown engaged into the latch track.

The "E"-Clip 24 shown in FIG. 2 is attached to the "E"-Clip groove 24A on latch pin extension 4 to maintain the fixed position of the latch pin 1 as an assembly in the adjustment linkage 5, as shown in FIG. 6. This fixed position is used to allow the adjustment linkage 5 to move from the locked mode,(position 1), to the close mode,(position 2), and allow ratcheting of the latch pin assembly 1 without interfering with the position of the selector knob 13.

FIG. 6 shows the locked mode. In the locked mode, the connecting rod 8 and the adjustment linkage 5 are fully extended distally relative to the selector hub 17 to fix the pin 6 in the portion of the slot B most proximal to the selector hub 17. In the present description, unless other wise indicated, the directions proximal and distal are relative to the selector hub 17.

In contrast, in the close mode the connecting rod 8 and the adjustment linkage 5 are pulled back proximally relative to the selector hub 17 by a distance sufficient that when the "E"-clip 24 contacts the spring retainer clip 3 the pin 6 is in a portion of the slot B distal to the selector hub 17. This permits the pin to slide between the distal and proximal portions within slot B during closing of the window lower sash 27.

The latch pin 1 is captured within a containment section by means of spring 2 and spring retaining clip 3, allowing the latch pin 1 to compress the spring 2 as the latch pin 1 moves further into the window sash 27. The spring retaining clip 3 is held in a fixed position by means of the spring retainer clip front slot 3A and rear slot 3B, as shown in FIG. 2, and the spring 2 biases the latch pin 1 distally, relative to the selector hub 17. The spring retaining clip 3 extends through a rectangular or tubular section used to capture the latch pin 1 to maintain the position of the latch pin spring 2. The latch pin spring 2, when compressed, allows the latch pin 1 to move over latch track 19, surface J (FIG. 8) within the latch track 19, when the window or door sash is moved within its accompanying frame.

In principle, the latch track 19 and latch pin 1 for a linear ratchet mechanism, allows motions in one direction by means of force applied to one captured and free sliding angled member against a fixed opposite angled surface. The sliding angled surfaces form a ramp allowing the captured sliding latch pin 1 to compress the latch pin spring 2 and traverse past the tip K of the latch track 19 cam surface J. The latch pin angled surface traverses past the latch ramp tip K and extends into the next latch track position by means of the latch pin spring 2, opposing force.

The rotatable selector hub assembly (described above) allows the latch pin 1 to operate in four (4) modes, i.e. locked, close (close only), raise (free sliding), and tilt (for angular pivoting of the window or door sash).

Figure 8:
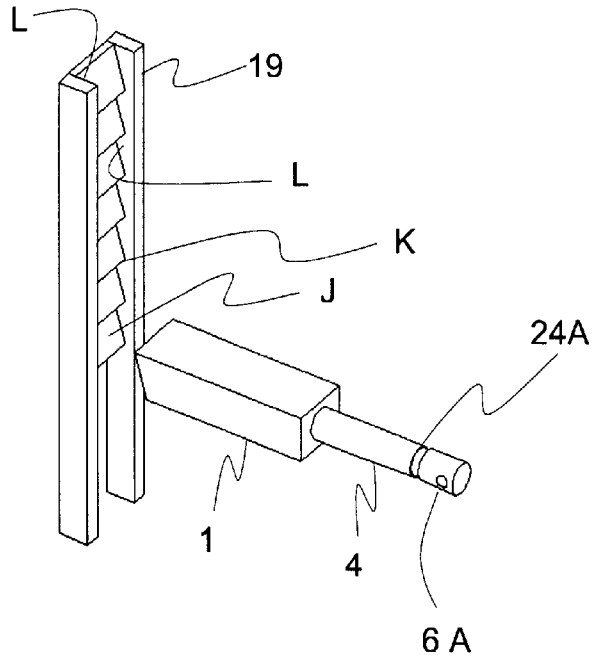
FIG. 8 is a fragmented isometric view of the latch track and latch of the embodiment of FIG. 1.

The latch track 19 provides a surface having a series of indentations for engaging the latch pin angled surface in the locked and slide positions. The surfaces of the indentations and the latch pin 1 angled surface N can have a variety of shapes as shown by FIGS. 8–8G. Each track indentation has a first surface and a second surface, the first surface (cam surface J) is inclined relative to the longitudinal axis of the track, and the first surface progressively rises in the movement direction towards the sash closed position. When the pins 16, 16', and the retaining plate 14 (FIG. 3) mate in the locked or close positions, the latch pin 1 distal end (distal relative to the rotary selector mechanism) engages at least one of the track indentations.

Figure 8A:
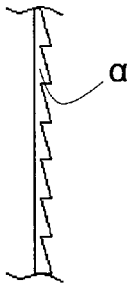
FIG. 8A is a fragmented plan view of a portion of the latch track of FIG. 8.

FIGS. 8 and 8A show the series of track indentations define a saw tooth surface which includes teeth having angled cam surface J and a second surface. The angled surface of the latch pin distal end engages the saw tooth surface when the rotary selector mechanism allows the latch pin 1 to operate in the locked position or close (close only) position. As shown in FIG. 8A the first surface (cam surface J) is typically inclined at an angle $\alpha$ from 15 to 70 degrees relative to the longitudinal axis of the guide rail slot and the second surface forms an angle of about 85 to 95 degrees (typically perpendicular) relative to the longitudinal axis of the latch track 19 and the latch pin 1 distal end defines a third surface that progressively rises in the movement direction away from the direction in which the sash 27 closes.

Figure 8B:
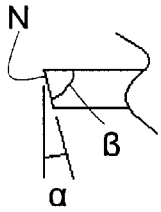
FIGS. 8B–8G are fragmented plan views of modifications to the latch track and latch of the embodiment of FIG. 8.

FIG. 8B shows the angled surface of the latch pin 1 distal end is typically inclined at an angle $\beta$ from 30 to 75 degrees relative to the longitudinal axis of the latch pin 1 (FIG. 8B) and this may compliment angle $\alpha$ to total 90 degrees. Typically, angle a of FIG. 8A and angle $\alpha$ of FIG. 8B have the same value of degrees.

Figure 8C:
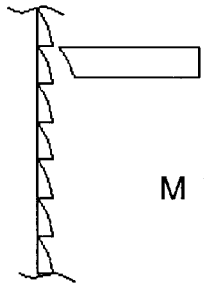

FIG. 8C shows an alternative embodiment in which the angled surface of the latch pin 1 distal end may be curved.

Figure 8D:
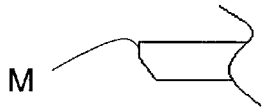

FIG. 8D shows an alternative embodiment wherein the tip M of the angled surface of the latch pin 1 distal end may be truncated.

Figure 8F:
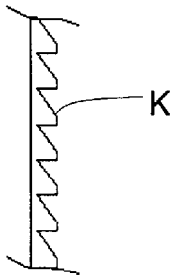
Figure 8G:
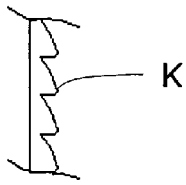
Figure 8E:
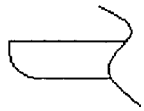

FIG. 8E shows the angled surface of the latch pin 1 distal end as curved rather than flat.

FIGS. 8F and 8G respectively show the tip K of the angled surface of the latch track 19 may be truncated or rounded.

A. Locked Mode

Figure 7:
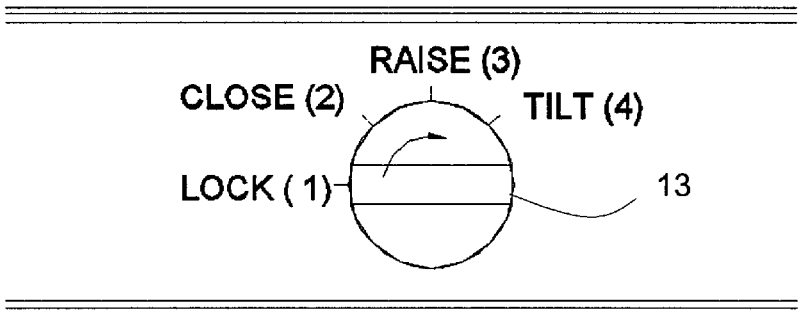
FIG. 7 is a plan view of the selector knob and associated angular detent positions of the embodiment of FIG. 1.

In the locked mode, the selector hub 17 is rotated, by the selector knob 13, to the first angular detent position as shown in FIG. 7. The latch pin 1 is forced into compression with the latch track 19 using selector hub 17 to extend connecting rod 8 and adjustment linkage 5, thereby forcing the latch pin 1 to be extended into the latch track 19 cam surface J. In the locked mode of this embodiment, the connecting rod 8 is fully extended and the selector hub 17 positioned such that the connecting rods 8 are diametrically opposed. In the fully extended position the adjustment linkage 5, is maintained at the locked position of slot B, preventing the latch pin 1 from retracting from the latch track 19. In the locked mode adjustment linkage pin 6 contacts the proximal end (relative to the selector hub 17) of slot B as shown in FIG. 6 when the latch pin 1 is in its distal most position of FIG. 9.

Figure 13:
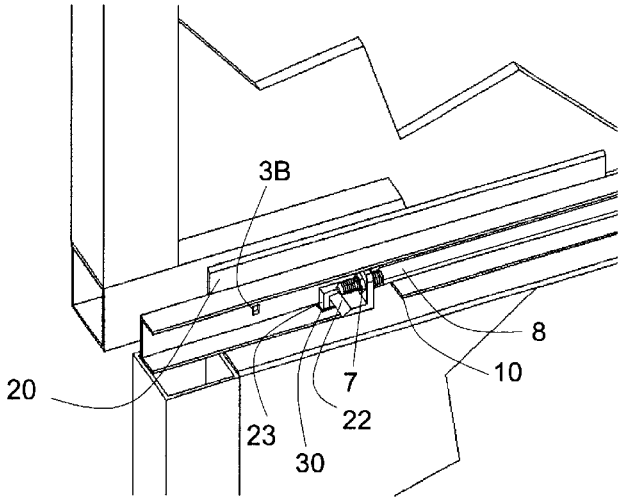
FIG. 13 is a sectioned and fragmented isometric view of an optional integrated catch for locking adjoining window of the embodiment of FIG. 1 or door sashes of a third embodiment of the present invention.
Figure 14:
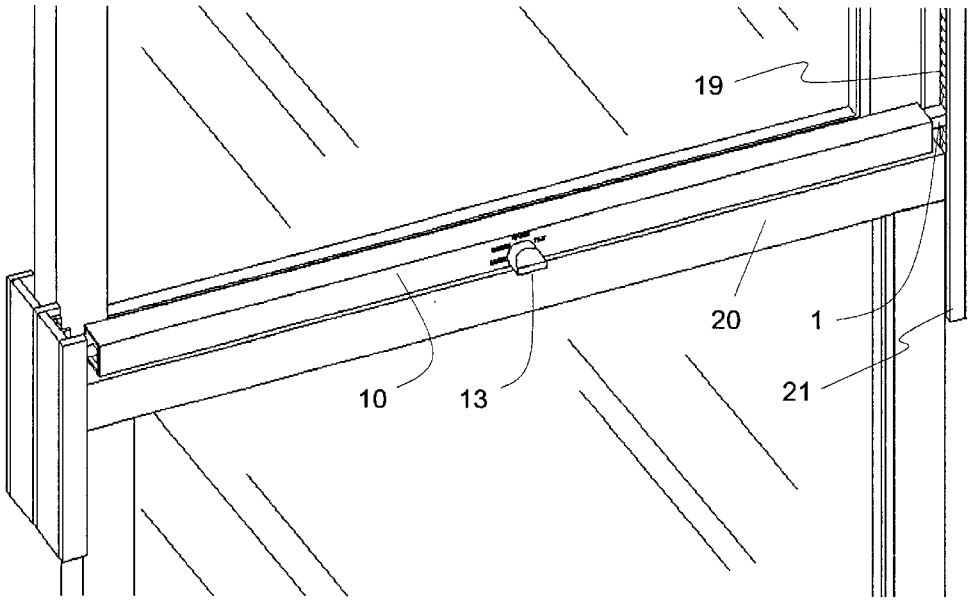
FIG. 14 is an isometric view of the latching system adapted to an existing window sash of a fourth embodiment of the present invention.

In the locked mode, the latching system also provides the capability to connect the adjoining sash of a door or window as shown in FIG. 13 and FIG. 6. A top catch 22 is a right angle catch and is attached to the connecting rod 8. The top catch 22 is held in place on the connecting rod 8 by use of jam nuts 7 (FIG. 2). The connecting rod 8 threaded end extends through a hole in the top catch 22. The jam nuts 7 are tightened to hold the right angle catch 22 in a position for engagement with an opposing bottom catch 23 attached to the bottom of the adjoining upper sash 26.

In the embodiment with vertically sliding sashes 26, 27, the bottom catch 23 extends horizontally from the bottom of the adjoining upper sash 26 and then upwardly through the bottom portion of the transverse rail 20 of the lower sash 27 in a fixed position. The top catch 22 is extended and retracted with the linear translation of the connecting rod 8. In the retracted position (selector hub 17 in the close, raise or tilt mode, the top catch 22 allows the bottom catch 23 to travel into an opening 30 (FIG. 13) in the bottom of the lower sash 27 transverse rail 20. After the bottom catch 23 travels into the opening 30, the selector hub 17 is then positioned to the locked position, extending the top catch 22 under the top extension of the bottom catch 23 and thereby preventing the separation of the sashes 26, 27.

B. Close Only Mode

In the close only mode, the selector hub 17 is rotated by the selector knob 13 to the second angular detent position as shown in FIG. 7. In contrast to the locked mode of FIG. 6, this allows the adjustment linkage 5 to be translated to a position where the linkage pin 6 is maintained at the left most point (using the orientation of FIG. 6, in other words the distal end relative to the selector hub 17) of the adjustment linkage 5 slot B when the latch pin 1 is in its distal most position of FIG. 9. This gives the linkage pin 6 the freedom to slide reciprocally within slot B as the lower window sash 27 is lowered. Thus, the lower window sash 27 may be moved in only one direction, namely downwardly.

Figure 9:
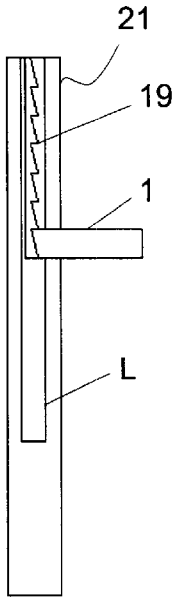
FIG. 9 is a plan view of the latch track with the latch in the locked/close mode, (depending on the position of selector knob 13).

Thus, when the selector knob 13 is turned to the close position (FIG. 7) the lower sash 27 can only be moved downwardly to further close the window 25. This is a significant security and safety feature. For example, a user can partially open a window to admit air with a benefit that a child cannot further open the window and accidentally fall out, nor can a burglar further open the window to gain access to the residence or business using this window. During downward movement of the lower sash 27 the latch pin 1, and thus adjustment linkage pin 6, are pushed proximally as the distal face of the latch pin 1 slides along latch track ramp surface J of a given tooth to permit downward movement of the lower sash 27. The latch pin 1 and adjustment linkage pin 6 snap distally when the latch pin 1 passes tip K of that tooth. Attempts at upward movement of the lower window sash 27 would push the latch pin 1 against the underside of that tooth to prevent upward movement. The distal most position of the latch pin 1 in the lock/close only mode is depicted in FIG. 9.

C. Raise/Free Sliding Mode

Figure 10:
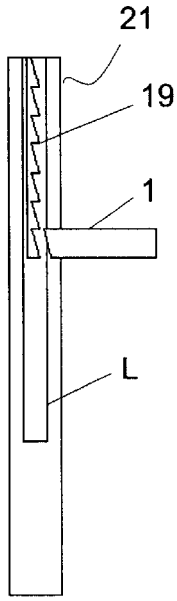
FIG. 10 is a plan view of the latch track and latch in the free sliding mode.

In the free sliding mode, the selector hub 17 is rotated to the third angular detent position as shown in FIG. 7, allowing adjustment linkage 5, to pull latch pin 1 proximally relative to the selector hub 17, to a position beyond the latch track 19, surface K, thereby compressing the latch pin spring 2. The latching system free sliding mode is maintained by the selector hub detent 16. In this position the latch pin 1 is maintained within the latch track walls L and L', preventing angular pivoting of the window or door sash within the window or door frame, as shown in FIG. 10. In this position, the pin 6 is maintained at the distal end (relative to the selector hub 17) of the adjustment linkage 5 slot B when latch pin 1 is in the position shown in FIG. 10.

D. Tilt/Pivoting Mode

Figure 11:
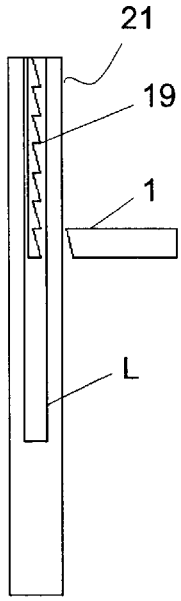
FIG. 11 is a plan view of the latch track and latch in the pivot/tilt mode.

In the angular pivoting mode, the selector hub 17 is rotated to the fourth angular detent position as shown in FIG. 7, allowing the latch pin 1 to retract past the latch track walls L, whereby the window or door sash can be pivoted about the window or door sash hinge point, as shown in FIG. 11.

The latch track 19 has walls L that keep latch pin 1 contained within the latch track 19. The walls L as shown in FIG. 8, prevent the window or door from being pivoted when the selector is not in the tilt/pivot mode. When the latch pin 1 is in the tilt position, the latch pin 1 is retracted past the height of the sidewall L allowing the window or door to pivot away from the latch track 19. In this position, the pin 6 is maintained at the distal end (relative to the selector hub 17) of the adjustment linkage 5 slot B when the latch pin 1 in the position shown by FIG. 11.

E. Sliding Glass Door

Figure 12:
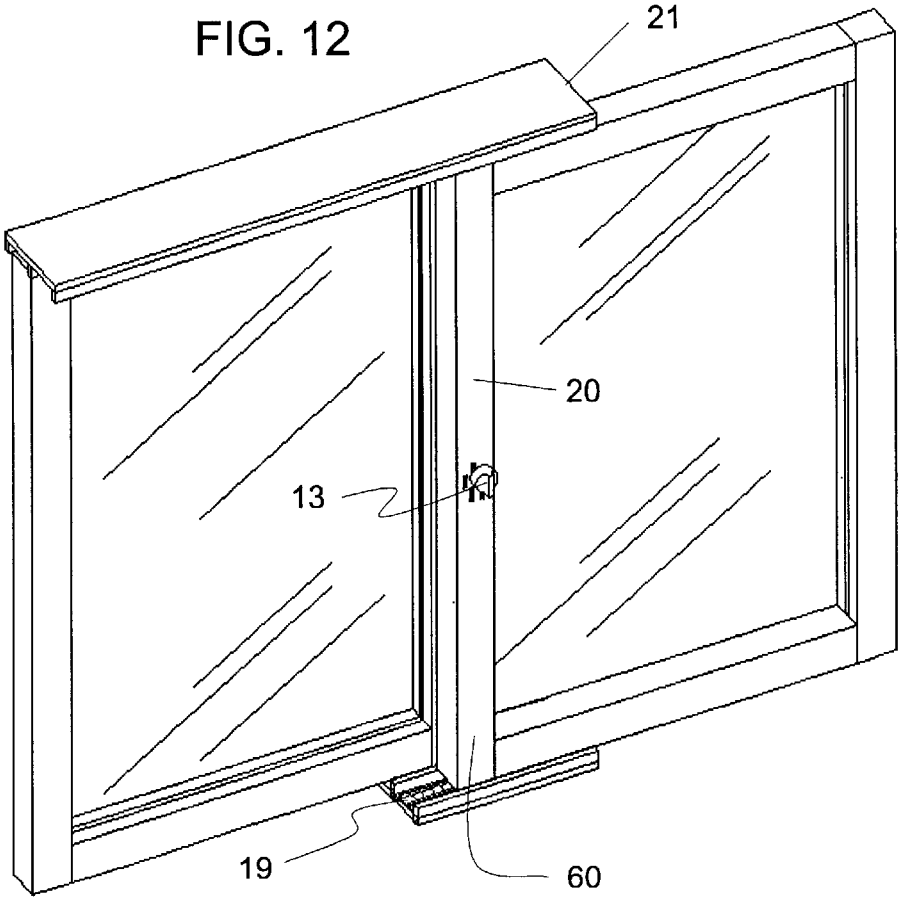
FIG. 12 is an isometric view of the latching system in a vertical orientation of a second embodiment of the present invention as, for example, for a sliding glass door.

FIG. 12 shows a fifth embodiment of the present invention wherein the above-described latching system is adapted for use with a horizontally sliding glass door or window 60 having sashes. At least one sash is movable. The latching system has a knob 13 on the meeting rail 20 on the movable sash of the sliding glass door or window, a latch track 19, and a door/window frame 21. Typically, the latch system for the sliding glass door would not have the tilt/pivoting mode.

It should be understood that embodiments other than those described above, and modifications of the above-described embodiments, may come within the spirit and scope of the present invention. Thus, the present invention is not defined by the above-provided description but rather is defined by the claims appended hereto.

I claim:

1. A latch mechanism for a horizontally or vertically sliding window having a window frame, the window frame including guide rails defining a guide rail slot extending in reciprocal sliding movement directions, a first sash and a second sash, the first sash is slidable with respect to the frame in the movement directions, each of the sashes having a meeting cross-member, the meeting cross-members transverse to the reciprocal sliding movement directions and adapted to lie alongside one another when the sashes are in a closed position;

the latch mechanism comprising:

a transverse crosspiece selected from the group consisting of the meeting cross-member of the first sash and a supplemental crosspiece attached to the meeting cross-member of the first sash, the transverse cross-piece having opposed first and second walls;

a rotatable stem protruding through the first wall of the transverse crosspiece, the first wall being an outer wall accessible during sliding;

a rotatable hub, wherein a portion of the stem engages the hub such that rotating the stem rotates the hub;

a compressible member;

a locking plate;

the compressible member biasing the hub and locking plate together, the compressible member located between the hub and a wall selected from the group consisting of the first wall of the transverse crosspiece and the second wall of the transverse crosspiece;

male protrusions protruding from a member of the group consisting of the hub and the locking plate, female indentations located in the other member of the group consisting of the hub and the locking plate, wherein the male protrusions mate with respective of the female indentations in at least a first position in which the sash is slidable in the movement directions and a second position in which the sash is locked to prevent sliding in at least one of the movement directions; and two rods, each rod having a first end pivotally attached to opposed sides of the rotatable hub, and each rod having a second end functionally attached to a spring biased window movement control mechanism.

2. The latch mechanism of claim 1, wherein the opposed first and second walls are a front wall and a back wall respectively.

3. The latch mechanism of claim 1, wherein in the second position the first sash is slidable along the guide rail slot in only one movement direction towards a sash closed position, and wherein the male protrusions further mate with respective of the female indentations in a third position in which the sash is locked to prevent sliding in the movement directions.

4. The latch mechanism of claim 1, wherein the male protrusions and respective of the female indentations further mate in a fourth position wherein the first sash is pivotably removable from the frame.

5. The latch mechanism of claim 1, wherein the compressible member and the locking plate contact opposed faces of the hub.

6. The latch mechanism of claim 1, wherein the compressible member is located between the hub and the second wall.

7. The latch mechanism of claim 1, wherein the movement directions are vertical and the opposed first wall is a top wall.

8. The latch mechanism of claim 1, wherein the opposed first and second walls are a front wall and a back wall, respectively, and the compressible member is a spring located between the hub and the back wall of the transverse crosspiece.

9. The latch mechanism of claim 1, wherein the male protrusions protrude from the hub and the female indentations are located on the locking plate.

10. The latch mechanism of claim 1, wherein the protrusions are formed by pins inserted into the hubs and the indentations are defined by a surface of the locking plate.

11. The latch mechanism of claim 10, wherein the pins inserted through the hub respectively pass through the rod first ends, to pivotably attach the rods to the hub.

12. The latch mechanism of claim 1, wherein the spring biased window movement control mechanism comprises:

a latch pin having a distal end portion and a proximal end portion relative to the hub, an attachment linkage attached to or integral with each rod second end, respectively, and having a distal end portion and a proximal end portion relative to the hub;

a second compression member biasing the latch pin distally relative to the hub, a first transverse opening defined by the distal end portion of the attachment linkage;

a second transverse opening defined by the proximal end portion of the latch pin, the first and second transverse openings being transverse to a longitudinal axis of the attachment linkage;

a transverse linkage pin located within the first and second transverse openings, the linkage pin attaching the attachment linkage and the latch pin;

wherein at least one member of the group consisting of the first transverse opening and the second transverse opening is a longitudinally elongated slot having a length in the longitudinal direction greater than its width, wherein the transverse linkage pin is longitudinally slidable within the longitudinally elongated slot, when the male protrusions mate with the female indentations in the second position, to extend the latch pin into the guide rail slot, permit reciprocal movement of the latch pin relative to the attachment member, and permit the first sash to slide in one of the movement directions.

13. The latch mechanism of claim 12, wherein the male protrusions and respective of the female indentations mate in the second position wherein the first sash is slidable along the guide rail slot in only one movement direction towards a sash closed position, and wherein the male protrusions further mate with respective of the female indentations in a third position in which the sash is locked to prevent sliding in the movement directions, wherein the transverse cross-piece is the meeting cross-member of the first sash, further comprising a first catch held onto the rod, a second catch protruding from the second sash, the second catch having an end for inserting into a hole in the first sash meeting cross-member to engage the first catch when the male protrusions mate with the female indentations in the third position.

14. The latch mechanism of claim 13, wherein the rod second end is threaded, further comprising two nuts screwed onto the rod threaded second end and the first catch is held onto the rod between the two nuts.

15. A latch mechanism for a horizontally or vertically sliding window having a window frame, the window frame including guide rails defining a guide rail slot extending in reciprocal sliding movement directions, a first sash and a second sash, the first sash is slidable with respect to the frame in the movement directions, each of the sashes having a meeting cross-member, the meeting cross-members transverse to the reciprocal sliding movement directions and adapted to lie alongside one another when the sashes are in a closed position;

the latch mechanism comprising:

a transverse crosspiece selected from the group consisting of the meeting cross-member of the first sash and a supplemental crosspiece attached to the meeting cross-member of the first sash, the transverse cross-piece having opposed first and second walls;

a rotatable stem protruding through the first wall of the transverse crosspiece, the first wall being an outer wall accessible during sliding;

a rotatable hub, wherein a portion of the stem engages the hub such that rotating the stem rotates the hub;

the hub being movable from at least a first position in which the sash is slidable in the movement directions to a second position in which the sash is locked to prevent sliding in one of the movement directions and permit sliding in another movement direction towards a sash closed position; and two rods, each rod having a first end pivotally attached to opposed sides of the rotating hub member, and each rod having a second end which is functionally attached to a spring biased window movement control mechanism, wherein the spring biased window movement control mechanism comprises:

a latch pin having a distal end portion and a proximal end portion relative to the stem, an attachment linkage attached to or integral with each rod second end, respectively, and having a distal end portion and a proximal end portion relative to the stem;

a compression member biasing the latch pin distally relative to the stem, a first transverse opening defined by the distal end portion of the attachment linkage;

a second transverse opening defined by the proximal end portion of the latch pin, the first and second transverse openings being transverse to a longitudinal axis of the attachment linkage;

a transverse linkage pin located within the first and second transverse openings, the transverse linkage pin attaching the attachment linkage and the latch pin;

wherein at least one member of the group consisting of the first transverse opening and the second transverse opening is a longitudinally elongated slot having a length in the longitudinal direction greater than its width, wherein the linkage pin is longitudinally slidable within the longitudinally elongated slot, when male protrusions mate with female indentations in the second position, to extend the latch pin into the guide rail slot, permit reciprocal movement of the latch pin relative to the attachment member, and permit sliding in one of the movement directions.

16. The latch mechanism of claim 15, wherein the first transverse opening of the attachment linkage comprises the longitudinally elongated slot and the linkage pin is slidable within the slot between a distal position relative to the stem and a proximal position relative to the stem.

17. The latch mechanism of claim 15, wherein the linkage pin is locked in the proximal position within the longitudinally elongated slot when the male protrusions mate with the female indentations in the first position.

18. The latch mechanism of claim 15, wherein the male protrusions further mate with respective of the female indentations in a third position in which the sash is locked to prevent sliding in the movement directions, wherein the linkage pin is locked in the distal position within the longitudinally elongated slot when the male protrusions mate with the female indentations in the third position.

19. The latch mechanism of claim 15, wherein the first transverse opening of the attachment linkage comprises the longitudinally elongated slot and the attachment linkage provides sufficient play for the attachment linkage and the latch pin to be pivotably attached by the transverse linkage pin.

20. The latch mechanism of claim 15, wherein the first transverse opening of the attachment linkage comprises the longitudinally elongated slot and the attachment linkage has a U-shaped transverse channel which transverses the first transverse opening and is open at a distal end of the attachment linkage.

21. The latch mechanism of claim 15, wherein the compression member is a linkage spring, and a linkage spring retainer clip is located within the transverse crosspiece, wherein a distal end of the linkage spring contacts a surface of the latch pin to outwardly bias the linkage pin and a proximal end of the linkage spring contacts the linkage spring retainer clip.

22. The latch mechanism of claim 15, wherein the attachment linkage is attached to the rod second end.

23. The latch mechanism of claim 15, wherein the attachment linkage is attached to the rod second end, wherein the attachment linkage proximal end has a threaded opening and the rod second end is threaded and screwed into the attachment linkage threaded opening.

24. The latch mechanism of claim 15, wherein the guide rail slot comprises a track having a series of indentations aligned along a longitudinal axis of the guide rail slot, wherein, when the male protrusions and the female indentations mate in the second position, the latch pin distal end engages at least one of the track indentations.

25. The latch mechanism of claim 24, wherein each track indentation has a first surface and a second surface, the first surface is inclined relative to the longitudinal axis of the track, and the first surface progressively rises in the movement direction towards the sash closed position, wherein, when the male protrusions and the female indentations mate in the second position, the latch pin distal end engages at least one of the track indentations.

26. The latch mechanism of claim 25, wherein the series of track indentations define a saw tooth surface, wherein the latch pin distal end engages the saw tooth surface when the male protrusions and the female indentations mate in the second position.

27. The latch mechanism of claim 25, wherein the first surface is inclined at an angle $\alpha$ from 15 to 70 degrees relative to the longitudinal axis of the guide rail slot and the second surface forms an angle of about 85 to 95 degrees with the longitudinal axis of the guide rail slot, and wherein the latch pin distal end defines a third surface that progressively rises in the movement direction away from the sash closed position.

28. The latch mechanism of claim 27, wherein the third surface forms an angle $\beta$ from 15 to 70 degrees relative to the longitudinal axis of the latch pin.

29. The latch mechanism of claim 15, wherein the stem is attached to a selector knob hidden from view, located on a front wall of the meeting cross-member of the first sash, inside a home, building or other structure incorporating the latch mechanism to be hidden from view from an exterior vantage point of the respective home, building or other structure incorporating the latch mechanism.

30. The latch mechanism of 29, wherein the rod second end is threaded, further comprising two nuts screwed onto the rod threaded second end and the first catch is held onto the rod between the two nuts, wherein the male protrusions and respective of the female indentations mate in the second position wherein the first sash is slidable along the guide rail slot in only one movement direction towards a sash closed position, and wherein the male protrusions further mate with respective of the female indentations in a third position in which the sash is locked to prevent sliding in the movement directions.

31. A latch mechanism for a horizontally or vertically sliding window having a window frame, the window frame including guide rails defining a guide rail slot extending in reciprocal sliding movement directions, a first sash and a second sash, the first sash is slidable with respect to the frame in the movement directions, each of the sashes having a meeting cross-member, the meeting cross-members transverse to the reciprocal sliding movement directions and adapted to lie alongside one another when the sashes are in a closed position;

the latch mechanism comprising:

the meeting cross-member of the first sash having opposed first and second walls;

a rotatable stem protruding through the first wall of the meeting cross-member of the first sash, the first wall being an outer wall accessible during sliding;

a rotatable hub, wherein a portion of the stem engages the hub such that rotating the stem rotates the hub;

the hub being movable from at least a sliding position in which the sash is slidable in the movement directions to a locking position in which the sash is locked to prevent sliding in the movement directions; and two rods, each rod having a first end pivotally attached to opposed sides of the rotating hub member, and each rod having a second end which is functionally attached to a window movement control mechanism, wherein the window movement control assembly comprises:

a respective latch pin having a distal end portion and a proximal end portion relative to the stem and functionally attached to or integral with each rod second end, respectively, and having a distal end portion relative to the stem and a proximal end portion relative to the stem, further comprising a first catch held onto the rod, a second catch protruding from the second sash and having an end for inserting into a hole in the first sash meeting cross-member to engage the first catch when protrusions mate with female indentations in the locking position, wherein in the locking position the sash is locked to prevent sliding in the movement directions.

* * * * *